United States Patent [19]

Quagliaro et al.

[11] 4,271,973

[45] Jun. 9, 1981

[54] STERILITY TESTING VESSEL

[75] Inventors: Daniel A. Quagliaro, Brooklyn, N.Y.; Walter E. Stiesi, Keansburg, N.J.

[73] Assignee: United States of America, Washington, D.C.

[21] Appl. No.: 22,220

[22] Filed: Mar. 19, 1979

[51] Int. Cl.[3] ..... B65D 51/16

[52] U.S. Cl. ..... 215/308; 215/261; 215/352; 220/371

[58] Field of Search ..... 220/371, 372, 373, 323, 220/326, 254, 357, 358; 215/261, 352, 308, 309, 248; 210/321 R, 445

[56] References Cited

U.S. PATENT DOCUMENTS

| | | | |
|---|---|---|---|
| 28,413 | 5/1860 | Sellers | 215/346 |
| 1,327,963 | 1/1920 | Ramsey | 215/345 X |
| 2,240,101 | 4/1941 | Smith | 215/261 X |
| 2,675,093 | 4/1954 | McCall et al. | 220/371 |
| 2,818,178 | 12/1957 | Hodsdon | 210/445 |
| 3,035,730 | 5/1962 | Walker et al. | 215/308 X |
| 3,471,051 | 10/1969 | Cistone | 215/261 X |
| 4,112,984 | 9/1978 | Guslia et al. | 220/371 X |
| 4,136,796 | 1/1979 | Dubois et al. | 220/371 X |

FOREIGN PATENT DOCUMENTS

| | | | |
|---|---|---|---|
| 1295468 | 3/1969 | Fed. Rep. of Germany | 215/261 |
| 589163 | 1/1978 | U.S.S.R. | 215/261 |

*Primary Examiner*—Allan N. Shoap
*Attorney, Agent, or Firm*—Holman & Stern

[57] ABSTRACT

A vessel is disclosed which is particularly suited to the sterility testing of drugs and medical equipment. The vessel comprises a glass container with a flat bottom and a plain cylindrical wall and a molded nylon cap which fits over the open end of the container. The cap has a skirt portion including a sealing ring which forms an airtight seal around the container and a top portion having a removable filter element held in place by a clip and which permits venting of the container.

10 Claims, 4 Drawing Figures

Fig. 1
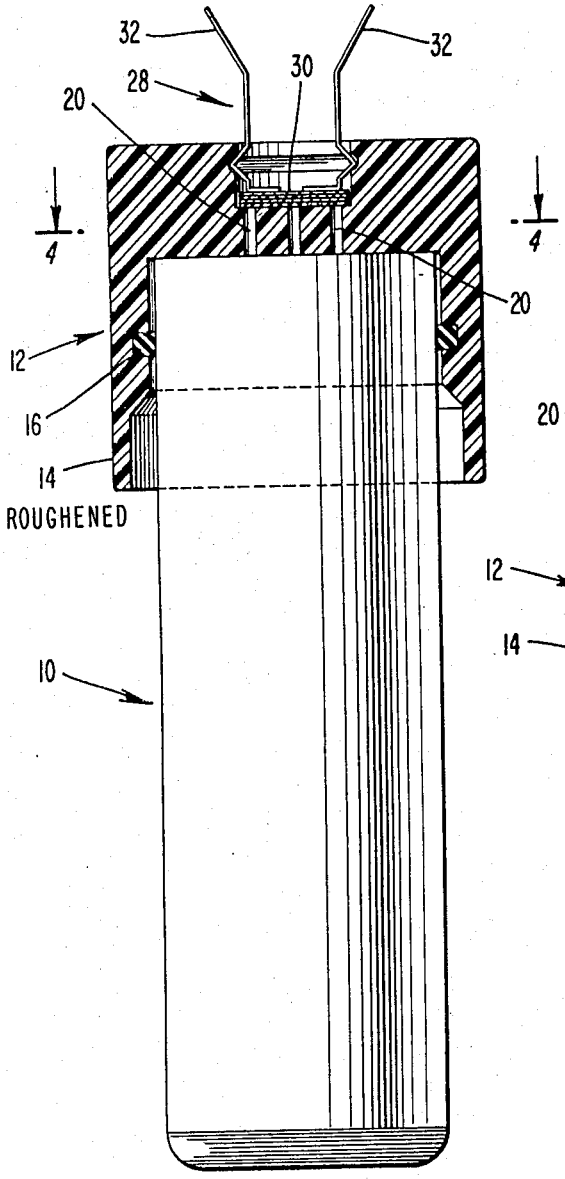
Fig. 2
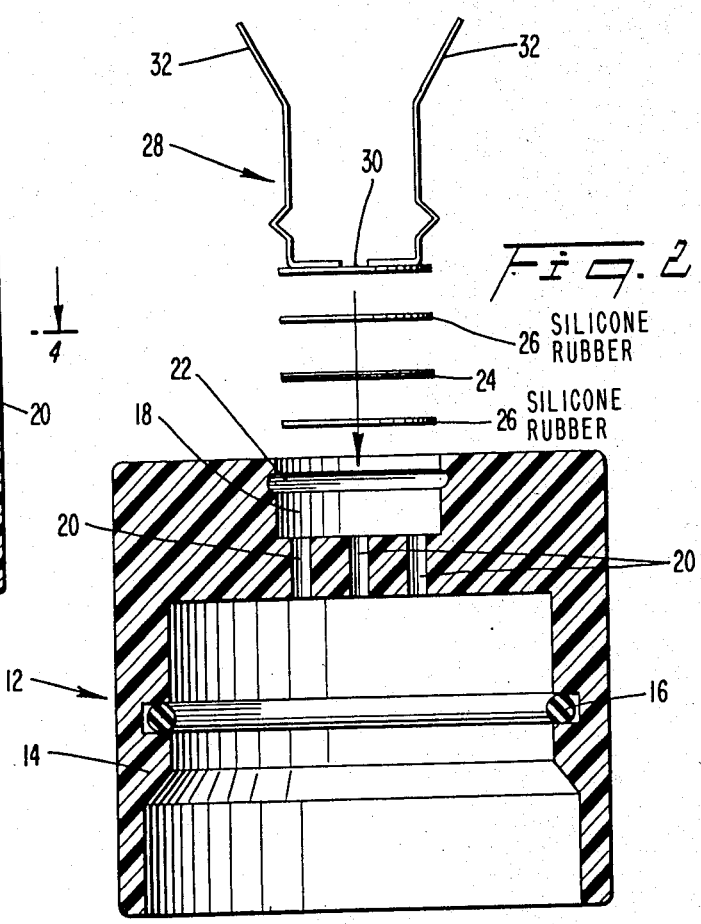
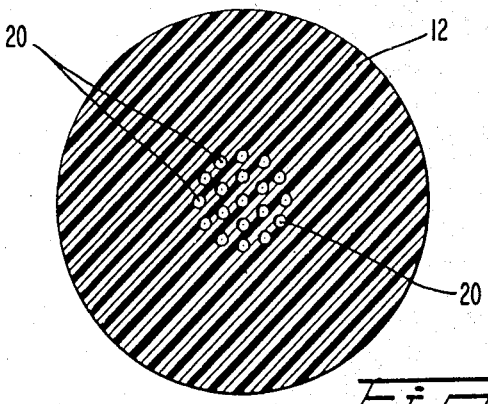
Fig. 4
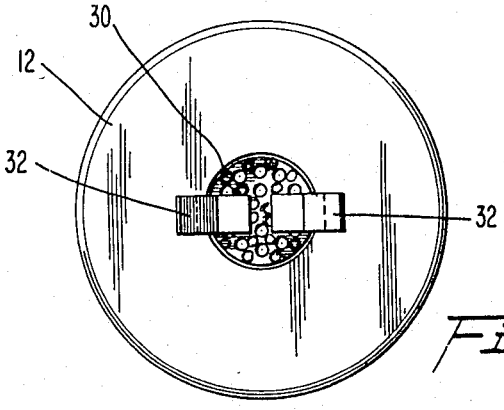
Fig. 3

STERILITY TESTING VESSEL

BACKGROUND OF THE INVENTION

This invention relates to a vessel suitable for use in testing the sterility of drugs, medical devices and the like. Such vessels are used, for example, in testing for the presence of microbiological contamination in drugs, bandages, catheters, syringes, sutures, gloves, and other medical equipment or components.

The object of sterility testing is to determine whether drugs and medical devices which are required to be sterile are in fact free of living organisms. The process entails opening a sealed product to be tested under highly aseptic environmental conditions and then introducing the product into a vessel containing an appropriate sterile culture medium. The vessel is closed and incubated for a specific time (for example, 14 days at 32° C.) and then examined for microbiological growth. Since a single cell can grow and result in a positive test, it is important to minimize the risk of external microbiological contamination, thus insuring that any growth which may occur can be attributed to an organism originally present in the product itself. It is accordingly important to insure that the vessel in which the product is incubated adequately protects the product from external contamination.

Although several types of culture tubes and vessels have been employed for sterility testing, generally these have not been designed specifically for this purpose and have disadvantages in relation to size, shape, ease of handling, susceptibility to external contamination and a tendency, with repeated autoclaving, to break or create a separation between the vessel and its closure.

It is an object of the present invention, therefore, to provide a vessel particularly suitable for use as a sterility testing vessel.

It is a further object of the invention to provide a specific form of closure for a sterility testing vessel which produces an effective sealing of the vessel against external contamination while still allowing venting of the vessel, for example, during autoclaving.

Another object of the invention is to provide a closure for a vessel which incorporates a form of filter structure that will permit venting of the vessel interior for example, during autoclaving while effectively sealing the vessel against external microbiological contamination.

Still a further object of the invention is to provide a sterility testing vessel which is simple to handle, can be easily cleaned and repeatedly used and which can be economically manufactured from readily available materials.

SUMMARY OF THE INVENTION

A vessel in accordance with the invention comprises a plain cylindrical container with a flat bottom, preferably made of borosilicate glass, with no neck constriction and a closure in the form of a one piece molded cap, preferably of nylon, having a skirt which fits over the neck of the container and includes an O-ring seal and a filter compartment in the top of the cap which houses a particular form of filter assembly, preferably a flat disc-type filter element, held in place by a special form of clip. Preferably, to facilitate handling, the skirt portion of the cap has a roughened outer surface with a sandpaper-like texture.

In use, the cap seals and protects the upper part of the cylinder, allows venting during autoclaving and cooling (via the filter) prevents airlock and generally promotes the maintenance of sterile conditions. The filter acts as a vent preventing pressure differences from building up thereby minimizing the risk of blowout. The filter and retaining clip assembly is such that the filter can be readily removed and inserted for cleaning or replacement purposes.

The glass cylinder can be made in a range of different heights of the same diameter to provide different capacity vessels each of which can be used with a standard size cap and the glass structure of the cylinder is of sufficient strength to allow repeated autoclaving.

DESCRIPTION OF DRAWINGS

FIG. 1 is a sectional elevation of a cylindrical container and attached cap in accordance with the invention.

FIG. 2 is an exploded view of the cap components.

FIG. 3 is a plan view of the assembled cap.

FIG. 4 is a section on line 4—4 of FIG. 1.

DETAILED DESCRIPTION OF PREFERRED EMBODIMENT

The illustrated vessel comprises a container 10 and a molded cap 12. Preferably the container is made from borosilicate glass and has a flat base and a plain cylindrical wall with no neck restriction. For example, the container may have an outside diameter of 2.24 inches and a wall thickness of 0.104 inches and can be made in varying heights conveniently 7 inches or 10 inches, the former accommodating 250 ml of culture medium and the latter 400 ml while leaving adequate head space for autoclaving and innoculation.

The cap is molded for example in nylon, and is formed with a skirt portion 14, the lower part of which is of slightly increased diameter to provide clearance around the container and the upper part of which has an internal circumferential groove, conveniently about ⅜th inches down from the internal top wall of the cap, and which carries a silicone rubber O-ring 16 which forms an airtight peripheral seal for the container when the cap is in place. The outer surface of the skirt portion is preferably roughened to a sandpaper-like texture to facilitate handling.

The top portion of the cap has a central recess 18 forming a filter compartment, the base of which communicates with the cap interior by way of passages 20, conveniently 19 in number. The peripheral wall of recess 18 has a circumferential groove 22.

A filter assembly fits into recess 18, the assembly comprising a membrane filter 24 (for example, a Gelman Teflon 200 membrane filter of 2.5 cm diameter with a pore size of 0.2 cm micrometers) sandwiched between two annular gaskets 26 preferably of silicone rubber and the assembly is held in place on the base of the recess by a retaining clip 28 of metal or other suitably resilient material. As shown, the clip preferably has a circular foraminous base portion 30 which rests on the top of the filter assembly and resilient arms 32 with detents which snap into groove 22 to positively retain the clip and the filter assembly in position. Removal of the clip and the filter assembly is effected simply by squeezing the free ends of the arms 32 towards each other. When the cap is removed, arms 32 of the clip can also be used to form a stand for the cap.

It can be seen that the construction of the vessel and the closure cap herein described is particularly suited for use in sterility testing applications. The cap is a simple push-fit onto the cylindrical container and the airtight O-ring seal 16 provides good protection to the container interior against external contamination. Further, the filter assembly allows for venting of the container interior while the pore size, when as described, is sufficiently small to prevent ingress of microbiological organisms. Further, the vessel lends itself to repeated autoclaving, is relatively simple to handle and use, and the filter assembly can be readily removed for cleaning or replacement.

While only a single embodiment of the invention has been described herein, it will be appreciated that the invention is not limited to the details thereof and numerous modifications are possible within the scope of the appended claims.

The embodiments of the invention in which an exclusive property or privelage is claimed are defined as follows:

1. A closure for a container suitable for use in testing the sterility of matter, said container having a cylindrical wall defining a container opening, the closure comprising a cap having a top portion and a cylindrical skirt portion depending from said top portion for fitting over said container wall, said skirt portion having a lower part with an increased diameter to provide clearance between the container and the lower skirt portion, said top portion having inner and outer surfaces and a recess formed in said top portion, said recess extending partially through said top portion from said outer surface, said recess including a peripheral wall and a base, passage means extending from said base of said recess to said inner surface of said top portion, a filter means receivable on said base of said recess and a resilient retention clip engagable with said peripheral wall of said recess for retaining said filter means in place, said retention clip including at least one manually operable resilient member extending out from and substantially above said recess when said clip is in place to readily permit selective removal of said clip.

2. The closure as defined in claim 1 wherein said filter means is a membrane filter element sandwiched between a pair of annular gaskets.

3. The closure as defined in claim 1 wherein said passage means comprises a plurality of passages distributed over the base of said recess.

4. The closure as defined in claim 1 wherein said skirt portion of said cap includes internal means for forming an airtight seal around said cylindrical wall of the container, and wherein said internal means comprising a circumferential groove in the internal wall of said skirt portion and a sealing ring secured in said groove.

5. The closure as defined in claim 1 wherein said skirt portion of said cap has a roughened outer surface to facilitate handling.

6. The closure as defined in claim 1 wherein said cap is molded of a synthetic plastic material.

7. The closure of claim 1 in combination with a container having a flat base and a plain cylindrical wall defining an opening opposite said base, said skirt portion of said closure member fitting over said cylindrical wall effectively to seal the container.

8. The combination of claim 2 wherein said container is made of borosilicate glass capable of repeatedly withstanding autoclaving temperatures without cracking.

9. A closure for a container having a cylindrical wall defining a container opening, the closure comprising a cap having a top portion and a cylindrical skirt portion depending from said top portion for fitting over said container wall, said top portion having inner and outer surfaces and a recess formed in said top portion, said recess extending partially through said top portion from said outer surface, said recess including a peripheral wall and a base, passage means extending from said base of said recess to said inner surface of said top portion, a filter means receivable on said base of said recess and a retention clip engagable with said peripheral wall of said recess for retaining said filter means in place; wherein said clip comprises a base portion for resting on top of said filter assembly and spaced resilient arms extending from said base portion for engaging opposed points on said peripheral wall of said recess to retain the clip and the filter means in place in said recess.

10. A closure as defined in claim 9 wherein said peripheral wall of said recess includes groove means and each of said arms of said clip includes a detent portion receivable in said groove means.

* * * * *